US011217186B2

(12) United States Patent
Xi et al.

(10) Patent No.: US 11,217,186 B2
(45) Date of Patent: Jan. 4, 2022

(54) DIMMING METHOD, DIMMING SCREEN, LIQUID CRYSTAL DISPLAY DEVICE AND COMPUTER READABLE STORAGE MEDIUM

(71) Applicant: BOE TECHNOLOGY GROUP CO., LTD., Beijing (CN)

(72) Inventors: Yanhui Xi, Beijing (CN); Yuxin Bi, Beijing (CN); Bin Dai, Beijing (CN); Xiaomang Zhang, Beijing (CN); Lingyun Shi, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/611,444

(22) PCT Filed: Apr. 4, 2019

(86) PCT No.: PCT/CN2019/081467
§ 371 (c)(1),
(2) Date: Nov. 6, 2019

(87) PCT Pub. No.: WO2019/201099
PCT Pub. Date: Oct. 24, 2019

(65) Prior Publication Data

US 2020/0243025 A1 Jul. 30, 2020

(30) Foreign Application Priority Data

Apr. 16, 2018 (CN) ..... 201810341706.2

(51) Int. Cl.
*G09G 3/34* (2006.01)

(52) U.S. Cl.
CPC ... *G09G 3/3426* (2013.01); *G09G 2320/0233* (2013.01); *G09G 2320/0646* (2013.01); *G09G 2320/0673* (2013.01); *G09G 2360/16* (2013.01)

(58) Field of Classification Search
CPC ..... G09G 3/3426; G09G 2320/0646; G09G 2320/0233; G09G 2360/16; G09G 2320/0673
See application file for complete search history.

(56) References Cited

U.S. PATENT DOCUMENTS

2008/0036872 A1 2/2008 Nobori
2009/0140665 A1 6/2009 Park
(Continued)

FOREIGN PATENT DOCUMENTS

CN 101101740 A 1/2008
CN 101453813 A 6/2009
(Continued)

OTHER PUBLICATIONS

First Office Action and English language translation, CN Application No. 201810341706.2, dated Aug. 5, 2019, 11 pp.

*Primary Examiner* — Roberto W Flores
(74) *Attorney, Agent, or Firm* — Myers Bigel, P.A.

(57) ABSTRACT

The present disclosure provides a dimming method for an LCD device. The LCD device includes a dimming screen and a display screen. The dimming screen is divided into N×M dimming areas, and the display screen is also divided into N×M display areas. N and M are respectively positive integers greater than or equal to 1. The dimming areas correspond to the display areas in a one-to-one relationship. The dimming method includes determining a regional eigenvalue of each of the dimming areas according to image data, determining a dimming brightness of each of the dimming areas according to each regional eigenvalue, and dimming
(Continued)

each of the dimming areas according to each dimming brightness. The present disclosure also provides a dimming screen for use in the dimming method and an LCD device using the dimming method.

16 Claims, 8 Drawing Sheets

(56) References Cited

U.S. PATENT DOCUMENTS

| | | | | |
|---|---|---|---|---|
| 2010/0220048 | A1 | 9/2010 | Yamamura et al. | |
| 2012/0112991 | A1 | 5/2012 | Hashimoto et al. | |
| 2014/0333673 | A1 | 11/2014 | Cho et al. | |
| 2016/0080720 | A1 | 3/2016 | Fullam | |
| 2016/0093252 | A1* | 3/2016 | Harada | G09G 3/3426 345/694 |
| 2016/0343340 | A1* | 11/2016 | Zheng | G09G 3/3607 |
| 2017/0098419 | A1 | 4/2017 | Kang et al. | |
| 2018/0277046 | A1* | 9/2018 | Lang | G09G 3/3426 |
| 2019/0147804 | A1* | 5/2019 | Zha | G09G 3/3406 345/691 |

FOREIGN PATENT DOCUMENTS

| | | | |
|---|---|---|---|
| CN | 102057420 | A | 5/2011 |
| CN | 102102824 | A | 6/2011 |
| CN | 102298908 | A | 12/2011 |
| CN | 102473388 | A | 5/2012 |
| CN | 103796380 | A | 5/2014 |
| CN | 104835468 | A | 8/2015 |
| CN | 107845368 | A | 3/2018 |
| CN | 108510947 | A | 9/2018 |

* cited by examiner

| | | |
|---|---|---|
| 1/16 | 2/16 | 1/16 |
| 2/16 | 4/16 | 2/16 |
| 1/16 | 2/16 | 1/16 |

Fig. 7

DIMMING METHOD, DIMMING SCREEN, LIQUID CRYSTAL DISPLAY DEVICE AND COMPUTER READABLE STORAGE MEDIUM

RELATED APPLICATIONS

The present application is a 35 U.S.C. 371 national stage application of PCT International Application PCT/CN2019/081467, with an international filing date of Apr. 4, 2019, which claims the benefit of Chinese Patent Application No. 201810341706.2, filed on Apr. 16, 2018, the entire disclosures of which are incorporated herein by reference.

FIELD

The present disclosure relates to the field of display technology, and more particularly to a dimming method and a dimming screen, a liquid crystal display (LCD) device and a computer readable storage medium.

BACKGROUND

At present, LCD devices have been widely applied in people's daily work and lives. Backlight dimming is currently the typical solution to local dimming of LCD devices. In this manner, light sources in various partitions will interact with each other due to the light diffusion so that it is impossible to precisely control the backlight brightness of the dimming for each partition and the halo phenomenon may be easily caused around a bright area, thereby resulting in a poor visual effect. Moreover, in this manner, it is also difficult to make data compensation for the backlight brightness of the dimming for each partition.

SUMMARY

According to the first aspect of the present disclosure, there is provided a dimming method for an LCD device. The LCD device comprises a dimming screen and a display screen, the dimming screen is divided into N×M dimming areas, the display screen is also divided into N×M display areas, wherein N and M are respectively positive integers greater than or equal to 1, and the dimming areas correspond to the display areas in a one-to-one relationship. The dimming method comprises: determining a regional eigenvalue of each of the dimming areas according to image data; determining a dimming brightness of each of the dimming areas according to each regional eigenvalue; and dimming each of the dimming areas according to each dimming brightness.

In some exemplary embodiments, the dimming method further comprises: correcting the dimming brightness by boundary smoothing filtering. In some exemplary embodiments, the dimming method further comprises: configuring a Gaussian smoothing filter to perform the boundary smoothing filtering.

In some exemplary embodiments, the dimming method comprises: determining the maximum or average value of gray scale in each of the is dimming areas respectively as the regional eigenvalue of each of the dimming areas according to the image data. In some exemplary embodiments, the dimming method further comprises: determining whether the regional eigenvalue is less than a threshold: if no, configuring the corresponding dimming brightness with the maximum brightness; and if yes, determining the corresponding dimming brightness in direct proportion to the regional eigenvalue.

In some exemplary embodiments, the dimming method further comprises: determining a target brightness of each of the display areas according to the image data and a correspondence between a gray scale and a target brightness; determining a transmittance of each of the display areas according to each target brightness and each corresponding dimming brightness; determining a target gray scale of each of the display areas according to each transmittance and a correspondence between a gray scale and a transmittance; and making data compensation according to each target gray scale.

In some exemplary embodiments, the target brightness is determined by the following formula:

$$L_{new} = \left(\frac{x}{255}\right)^{Gamma} g(L_{255-new} - L_{0-new}) + L_{0-new};$$

wherein $L_{new}$ is the target brightness, x is the gray scale, Gamma is a curvature coefficient of the gray scale and the brightness, $L_{255\text{-}new}$ is the maximum brightness of the display screen after dimming, $L_{0\text{-}new}$ is the minimum brightness of the display screen after dimming, and g is a proportional coefficient.

In some exemplary embodiments, the transmittance is determined by the following formula:

$$\eta = \frac{L_{new}}{L_{LCD1}};$$

wherein η is the transmittance; $L_{new}$ is the target brightness; and $L_{LCD1}$ is the dimming brightness corresponding to the target brightness.

According to another aspect of the present disclosure, there is provided a dimming screen for an LCD device. The dimming screen is divided into N×M dimming areas, wherein N and M are respectively positive integers greater than or equal to 1. The dimming screen comprises: a first computer configured to determine a regional eigenvalue of each of the dimming areas according to image data and determine a dimming brightness of each of the dimming areas according to each regional eigenvalue, and the dimming screen further comprises a dimmer configured to dim each of the dimming areas according to each dimming brightness.

In some exemplary embodiments, the dimming screen further comprises a filter configured to correct the dimming brightness by boundary smoothing filtering. In some exemplary embodiments, the filter of the dimming screen comprises a Gaussian smoothing filter.

In some exemplary embodiments, the first computer of the dimming screen is further configured to determine the maximum or average value of gray scale in each of the dimming areas respectively as the regional eigenvalue of each of the dimming areas according to the image data. In some exemplary embodiments, the first computer of the dimming screen is further configured to determine whether the regional eigenvalue is less than a threshold: if no, configure the corresponding dimming brightness with the maximum brightness; and if yes, determine the corresponding dimming brightness in direct proportion to the regional eigenvalue.

In another aspect of the present disclosure, there is provided an LCD device comprising the dimming screen as stated above. The LCD device further comprises a display screen. The display screen is divided into N×M display areas, wherein N and M are respectively positive integers greater than or equal to 1, and the dimming areas correspond to the display areas in a one-to-one relationship; the display screen comprises a second computer, a data compensation processor and a display panel, wherein the second computer is configured to determine a target brightness of each of the display areas according to the image data and a correspondence between a gray scale and a target brightness, determine a transmittance of each of the display areas according to each target brightness and each corresponding dimming brightness, and determine a target gray scale of each of the display areas according to each transmittance and a correspondence between a gray scale and a transmittance; the data compensation processor is configured to make data compensation according to each target gray scale; and the display panel is configured to display in each of the display areas according to each target gray scale after data compensation.

In some exemplary embodiments, the second computer of the display screen determines the target brightness according to the following formula:

$$L_{new} = \left(\frac{x}{255}\right)^{Gamma} g(L_{255-new} - L_{0-new}) + L_{0-new};$$

wherein $L_{new}$ is the target brightness, x is the gray scale, Gamma is a curvature coefficient of the gray scale and the brightness, $L_{255-new}$ is the maximum brightness of the display screen after dimming, $L_{0-new}$ is the minimum brightness of the display screen after dimming, and g is a proportional coefficient.

In some exemplary embodiments, the second computer of the display screen determines the transmittance by the following formula:

$$\eta = \frac{L_{new}}{L_{LCD1}};$$

wherein η is the transmittance; $L_{new}$ is the target brightness; and $L_{LCD1}$ is the dimming brightness corresponding to the target brightness.

According to another aspect of the present disclosure, there is provided a non-volatile computer readable storage medium, on which a computer program is stored, and the computer program when executed by a processor realizes the dimming method as stated above.

According to the exemplary embodiments described below, these and other aspects of the present disclosure will be clearly understood and be expounded with reference to the exemplary embodiments described below.

BRIEF DESCRIPTION OF DRAWINGS

The above-mentioned and/or other features, objectives and advantages of the present disclosure will be clearer through reading the detailed depiction of non-limiting exemplary embodiments with reference to the following drawings:

FIG. 7 is a schematic view of a Gaussian smoothing filter applicable in the dimming method shown in FIG. 6;

Throughout all the drawings, like reference numerals indicate the same components, elements, devices and/or steps.

DETAILED DESCRIPTION

The present disclosure will be described in detail hereinafter with reference to the drawings and exemplary embodiments. The drawings and their corresponding literal descriptions are used only to illustrate some exemplary embodiments of the present disclosure, but the scope of the present disclosure is not limited thereto. After reading the contents of the present disclosure, a person skilled in the art may make any appropriate modification or variation to the exemplary embodiments described without departing from the spirit and scope of the present disclosure. These modifications or variations also fall within the scope of the protection of the present disclosure.

It will be understood that, although the terms "first", "second", "third", etc. may be used herein to describe various elements, components and/or parts, these elements, components and/or parts should not be limited by these terms. These terms are only used to distinguish one element, component or part from another. Therefore, a first element, component or part discussed below could be termed as a second element, component or part, without departing from the scope of the present disclosure.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises", "comprising", "includes", and/or "including" when used herein specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It will be understood that when an element is referred to as being "connected", "coupled" or "adjacent" to another element, it can be directly connected, coupled or adjacent to the other element or intervening elements may be present. In contrast, when an element is referred to as being "directly connected", "directly coupled" or "directly adjacent" to another element, there are no intervening elements present.

Unless otherwise defined, all terms (including technical and scientific terms) used herein have the same meaning as commonly understood by one of ordinary skill in the art to which this disclosure belongs. It will be further understood that terms such as those defined in a commonly used dictionary should be interpreted as having a meaning that is consistent with their meaning in the relevant art and/or the context of this specification and will not be interpreted in an idealized or overly formal sense unless expressly so defined herein.

Figure 1:
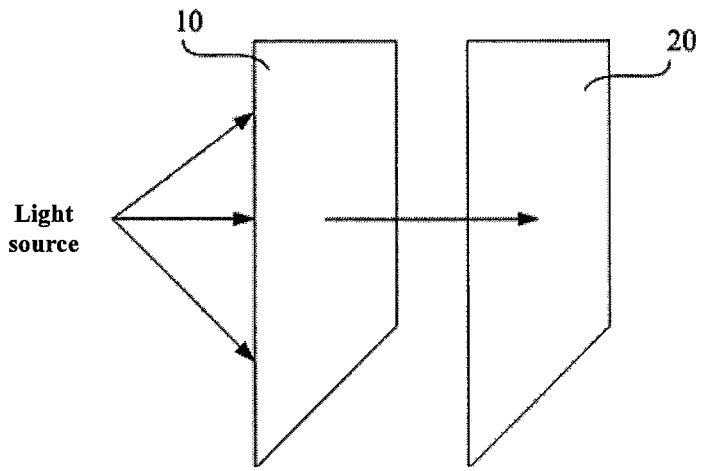
FIG. 1 schematically shows the relative arrangement of a dimming screen and a display screen in an LCD device according to an exemplary embodiment of the present disclosure.

FIG. 1 schematically shows the relative arrangement of a dimming screen 10 and a display screen 20 in an LCD device according to an exemplary embodiment of the present disclosure. The dimming screen 10 may be divided into N×M dimming areas, the display screen 20 may also be divided into N×M display areas, wherein N and M are respectively positive integers greater than or equal to 1. The dimming screen 10 and the display screen are disposed opposite to each other so that the dimming areas correspond to the display areas in a one-to-one relationship. In an exemplary embodiment, the dimming area and the display area may be configured as a single pixel. For example, the resolution of the dimming screen 10 and the display screen 20 may be m×n, so the dimming screen 10 may comprise m×n dimming areas, and the display screen 20 may correspondingly comprise m×n display areas. Alternatively, the dimming area and the display area may also be configured as a combination of a plurality of pixels, such as a combination of 2/4/6/9/16 pixels or the like.

A light source and the display screen 20 may be disposed at both sides of the dimming screen 10 respectively, so that the light from the light source can illuminate on the dimming screen 10 and then reach the display screen 20 after the dimming of the dimming screen 10. The light source may be any suitable light source, for example, but not limited to, a light-emitting diode (LED) light source or the like. Moreover, FIG. 1 only illustrates an exemplary arrangement of the light source with respect to the dimming screen 10, and the present disclosure is not limited thereto. In some exemplary embodiments, the light emitted from the light source may also pass through a corresponding optical element (for example, but not limited to, a polarized element, a filtering element or the like) before illuminating on the dimming screen 10. The dimming screen 10 may precisely configure the dimming brightness of each of the dimming areas, thereby realizing precise backlight local dimming for the display screen 20. In addition, the display screen 20 may also make accurate data compensation based on the dimming brightness of the dimming screen 10, thereby further improving the display visual effect.

The principle of controlling the dimming brightness and making data compensation will be introduced in detail hereinafter with reference to FIGS. 2 to 7.

Figure 2:
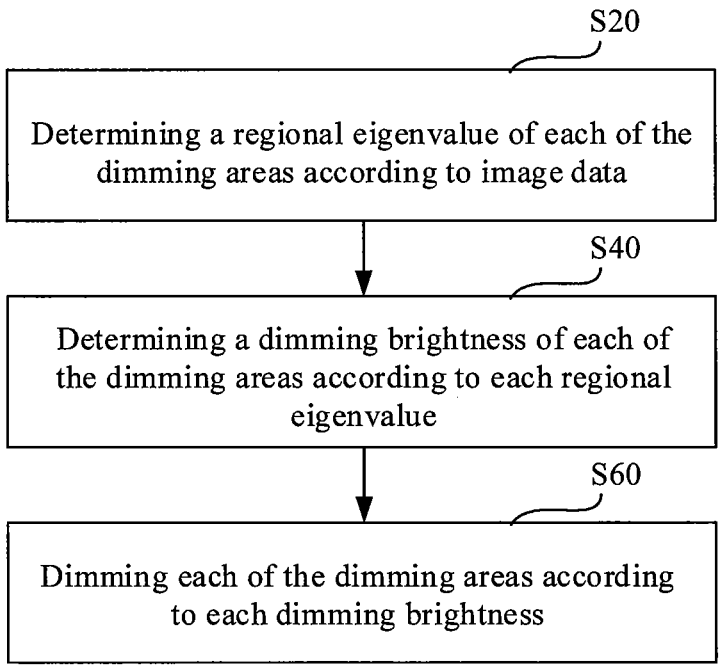
FIG. 2 is a schematic flowchart of a dimming method according to an exemplary embodiment of the present disclosure.

FIG. 2 is a flowchart of a dimming method according to an exemplary embodiment of the present disclosure. As shown in FIG. 2, the dimming method according to the exemplary embodiment comprises the steps of:

S20: determining a regional eigenvalue of each of the dimming areas according to image data;

S40: determining a dimming brightness of each of the dimming areas according to each regional eigenvalue; and S60: dimming each of the dimming areas according to each dimming brightness.

Any suitable data obtained from the image data may be used as the regional eigenvalue of the dimming area, and the dimming brightness of each of the dimming areas may be configured based on the regional eigenvalue in any suitable manner. These aspects will be further explained in detail hereinafter. Furthermore, dimming may be conducted by a drive circuit after determining the dimming brightness of each of the dimming areas. The specific circuit driving method may be a method commonly used in the art, which will not be reiterated herein.

Figure 3:
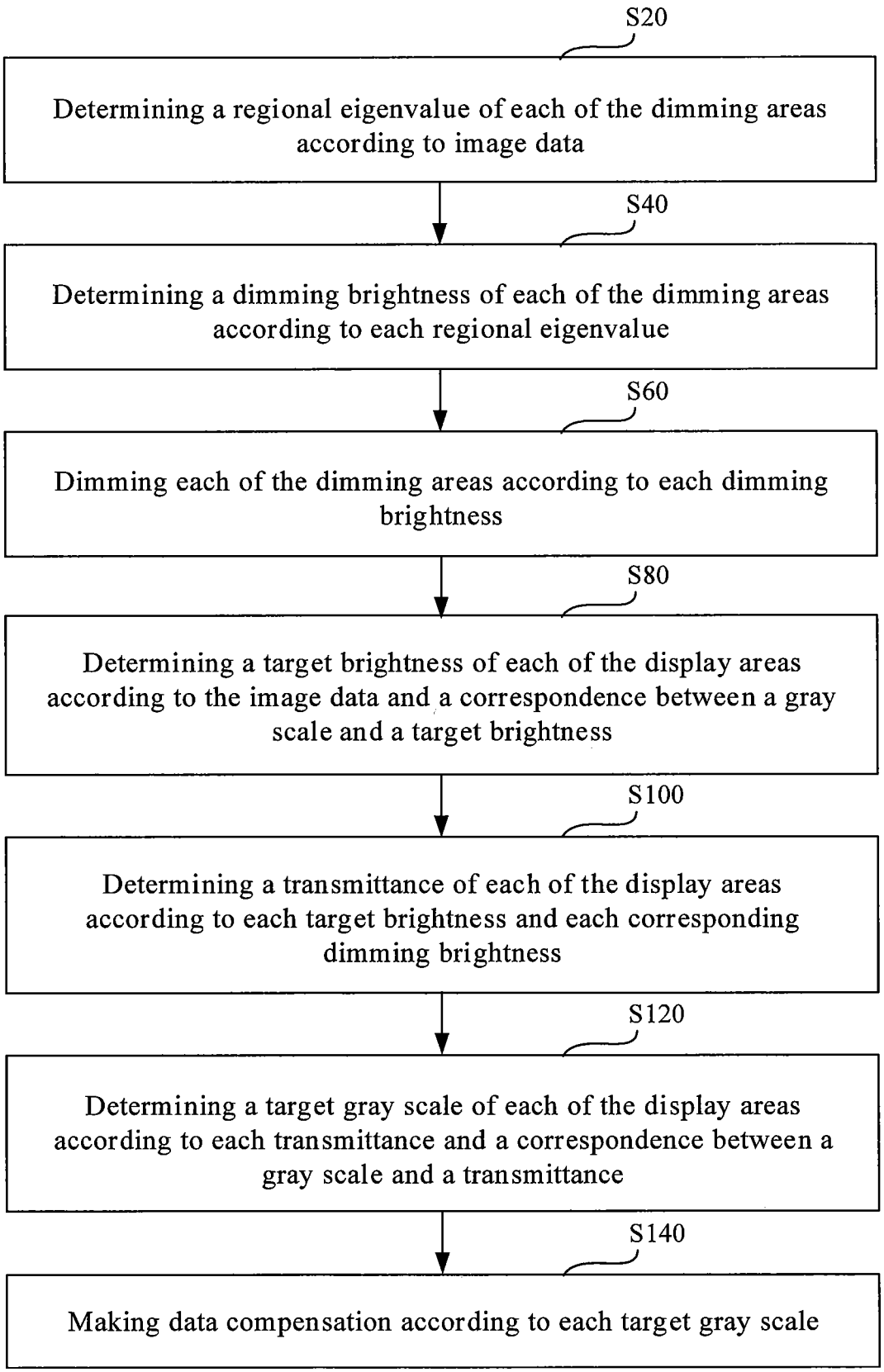
FIG. 3 is a schematic flowchart of a dimming method according to another exemplary embodiment of the present disclosure.

FIG. 3 is a flowchart of a dimming method according to another exemplary embodiment of the present disclosure. In comparison with the dimming method as shown in FIG. 2, the dimming method in FIG. 3 further comprises: compensating the display data of the corresponding display area based on the dimming brightness configured for each of the dimming areas. Thus, in addition to the steps of the dimming method as shown in FIG. 2, the dimming method further comprises the steps of:

S80: determining a target brightness of each of the display areas according to the image data and the correspondence between a gray scale and a target brightness;

S100: determining a transmittance of each of the display areas according to each target brightness and each corresponding dimming brightness;

S120: determining a target gray scale of each of the display areas according to each transmittance and a correspondence between a gray scale and a transmittance; and S140: making data compensation according to each target gray scale.

The specific data compensation method may be a method commonly used in the art, which will not be reiterated herein.

Figure 4:
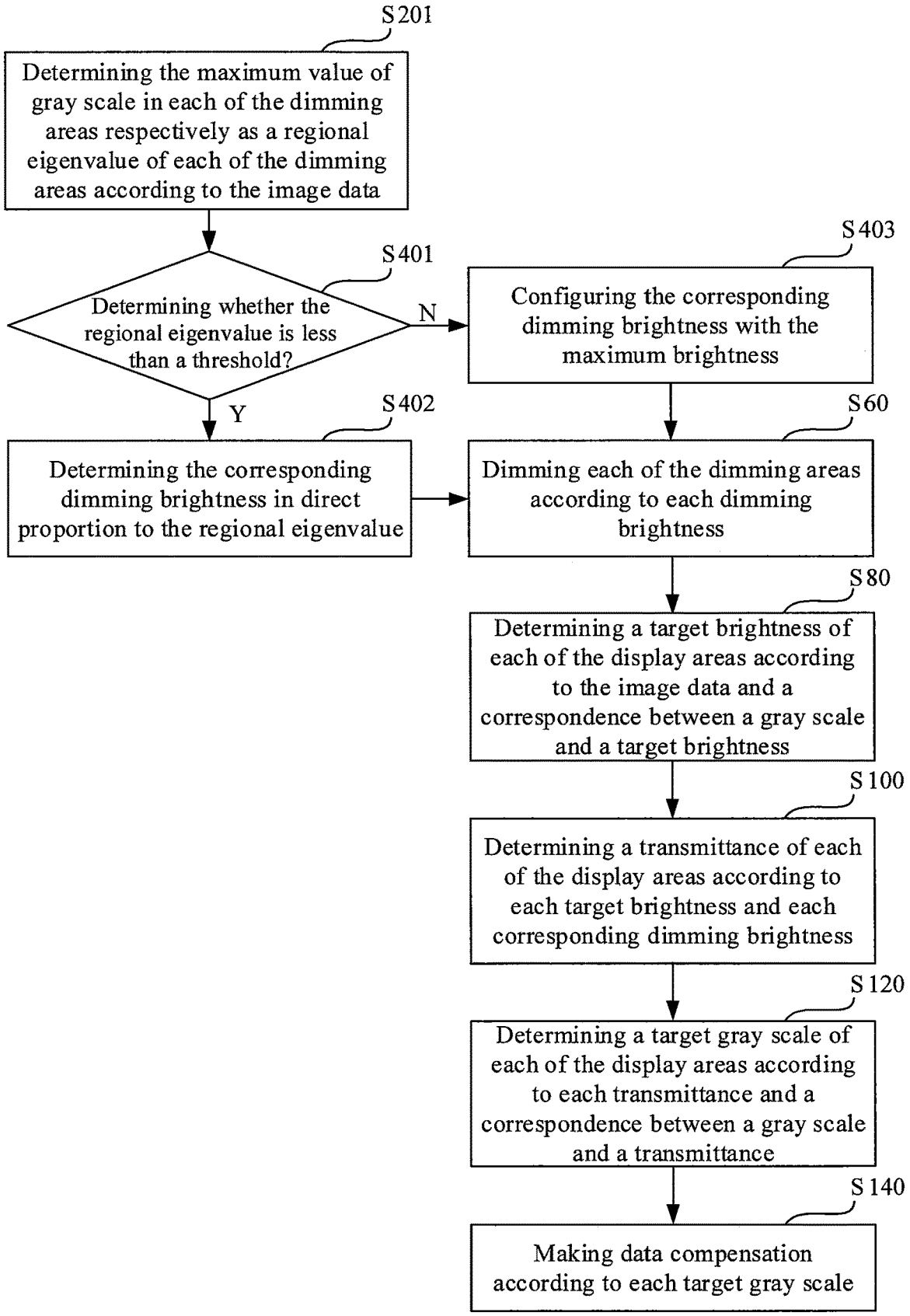
FIG. 4 is a schematic flowchart of a dimming method according to a further exemplary embodiment of the present disclosure.

FIG. 4 is a schematic flowchart of a dimming method according to a further exemplary embodiment of the present disclosure. In comparison with the dimming method as shown in FIG. 3, the dimming method in FIG. 4 further defines the steps S20 and S40 as stated above. Thus, in addition to the steps S60-S140 of the dimming method as shown in FIG. 3, the dimming method further comprises the steps of:

S201: determining the maximum value of gray scale in each of the dimming areas respectively as the regional eigenvalue of each of the dimming areas according to the image data;

S401: determining whether the regional eigenvalue is less than a threshold:

if yes, executing a step S402: determining the corresponding dimming brightness in direct proportion to the regional eigenvalue; and if no, executing a step S403: configuring the corresponding dimming brightness with the maximum brightness.

In the step S201, the gray scale of each pixel in each of the dimming areas may be obtained according to the image data so as to determine the maximum value of the gray scale of each of the dimming areas to be the regional eigenvalue of each of the dimming areas. In some other exemplary embodiments, when the dimming area comprises a plurality of pixels, a similar technical effect may be realized by a different regional eigenvalue configuration method, such as determining the average value of a plurality of gray scales of the dimming area to be the regional eigenvalue of the dimming area.

In the step S401, the regional eigenvalue determined in the step S201 is compared with the threshold so as to select the corresponding dimming brightness configuration in the step S402 or S403 according to the comparison result. The threshold may be pre-configured according to experience, or may be acquired by deep learning model training and prediction, or may also be configured through dynamic adjustment according to the dimming effect.

When the regional eigenvalue is less than the threshold, the step S402 is executed to determine the corresponding dimming brightness in direct proportion to the regional eigenvalue. When the regional eigenvalue is not less than the threshold, the step S403 is executed to configure the corresponding dimming brightness with the maximum brightness.

Figure 5:
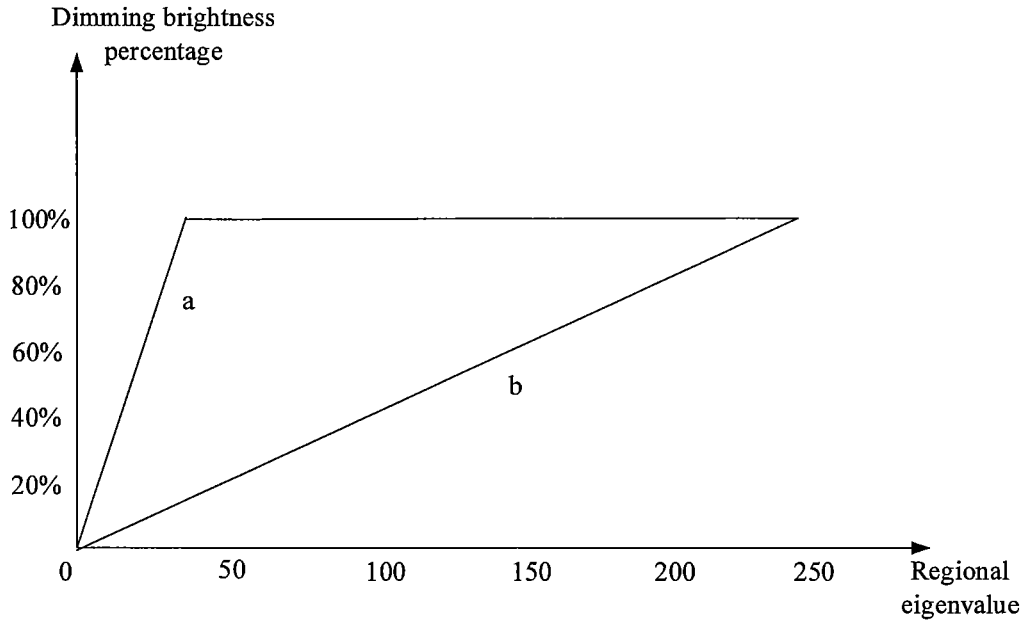
FIG. 5 is a schematic view showing the comparison between the dimming brightness configuration in the dimming method shown in FIG. 4 and a conventional dimming brightness configuration.

FIG. 5 is a schematic view showing the comparison between the dimming brightness configuration in the dimming method shown in FIG. 4 and a conventional dimming brightness configuration.

As shown in FIG. 5, a curve a is the dimming brightness configuration curve of the dimming method as shown in FIG. 4, and a curve b is the dimming brightness configuration curve of a conventional display screen. The curve a comprises two parts: an oblique part and a straight part. In some exemplary embodiments, the oblique part of the curve a is determined by a function, $y=q/p(q\leq p)$, wherein y is the percentage of dimming brightness, p is a threshold, and q is an regional eigenvalue. In other exemplary embodiments, the function of the oblique part of the curve a may be configured as any function of direct proportion, and a similar technical effect may be realized as long as the regional eigenvalue is in direct proportion to the dimming brightness. In comparison with a conventional dimming brightness configuration, the adoption of the dimming brightness configuration shown by the curve a in FIG. 5 may enhance the contrast while effectively reducing the interference between partitions.

With further reference to FIGS. 2 and 3, in some other exemplary embodiments, the step S20 may also adopt a different configuration, such as segmented dimming brightness configuration. For instance, when the regional eigenvalue is within a first segment, the corresponding dimming brightness is configured as first brightness (such as 0.9 times the maximum value), when the regional eigenvalue is within a second segment, the corresponding dimming brightness is configured as second brightness (such as 0.95 times the maximum value), when the regional eigenvalue is within a third segment, the corresponding dimming brightness is configured as third brightness (such as the maximum value), etc.

With further reference to FIGS. 3 and 4, in some other exemplary embodiments, in the step S80, the target brightness of each of the display areas may be determined according to the pre-stored correspondence between the gray scale and the target brightness, and the gray scale of the display area determined according to the image data.

To be specific, there are the following known parameters for the display screen: the maximum brightness before dimming $L_{255\text{-}old}$, the minimum brightness before dimming $L_{0\text{-}old}$, the maximum brightness after dimming $L_{255\text{-}new}$, and the minimum brightness after dimming $L_{0\text{-}new}$.

According to the relationship curve between the gray scale and the brightness of the display screen (also known as the Gamma curve, usually Gamma=2.2), the brightness corresponding to each gray scale before the dimming of the display screen may be determined according to the following formula:

$$L_{old} = \left(\frac{x}{255}\right)^{Gamma} g(L_{255-old} - L_{0-old}) + L_{0-old}$$

wherein $L_{old}$ is the brightness before dimming, x is the gray scale, Gamma is a curvature coefficient of the gray scale and the brightness, and g is a proportional coefficient;

and the target brightness corresponding to each gray scale after the dimming of the display screen may be determined according to the following formula:

$$L_{new} = \left(\frac{x}{255}\right)^{Gamma} g(L_{255-new} - L_{0-new}) + L_{0-new};$$

wherein $L_{new}$ is the target brightness.

According to the above formulas, a correspondence table between the gray scale and the original brightness before dimming, as well as the target brightness after dimming as shown in the following Table 1 may be generated. The correspondence table may be pre-stored so as to determine the target brightness of each of the display areas by lookup and comparison.

TABLE 1

Correspondence Table Between Gray Scale and Original Brightness, as well as Target Brightness

| Gray scale | Original brightness | Target brightness |
|---|---|---|
| 0 | $L_{0\text{-}old}$ | $L_{0\text{-}new}$ |
| 1 | $L_{1\text{-}old}$ | $L_{1\text{-}new}$ |
| 2 | $L_{2\text{-}old}$ | $L_{2\text{-}new}$ |
| . . . | . . . | . . . |
| 255 | $L_{255\text{-}old}$ | $L_{255\text{-}new}$ |

In some exemplary embodiments, the correspondence between the gray scale and the target brightness as stated above may be adjusted according to actual demands, such as configuring different curvature coefficients and/or proportional coefficients, and/or adding a constant parameter.

In the step S100, the transmittance of each of the display areas may be determined according to the target brightness of each of the display areas determined in the step S80 and the dimming brightness of each of the dimming areas determined in the step S40:

$$\eta = \frac{L_{new}}{L_{LCD1}};$$

wherein η is transmittance and $L_{LCD1}$ is dimming brightness corresponding to the target brightness $L_{new}$. The transmittance η reflects the light transmittance of the display screen 20.

In the step S120, the target gray scale of each of the display areas may be determined according to the transmittance of each of the display areas determined in the step S100 and by looking up the pre-stored correspondence between the gray scale and the transmittance. The correspondence between the gray scale and transmittance of the display area may be determined according to the inherent parameters of the display screen 20. In an exemplary embodiment, the correspondence may be configured as the following Table 2.

TABLE 2

| Correspondence Table Between Gray Scale and Transmittance | |
|---|---|
| Gray scale | transmittance |
| 0 | $\eta_0$ |
| 1 | $\eta_1$ |
| 2 | $\eta_2$ |
| . . . | . . . |
| x | $\eta_x$ |
| . . . | . . . |
| 255 | $\eta_{255}$ |

By looking up Table 2, for a display area, if $\eta=\eta_{x1}$, the target gray scale of the display area is x1.

In other exemplary embodiments, the correspondence between the gray scale and transmittance of the display area may also be configured in the form of a lookup function.

After determining the target gray scale of each of the display areas, data compensation may be performed by the data compensation method known in the art.

The above exemplary embodiments precisely configure the dimming brightness of each dimming area, and precisely configure the target gray scale by means of the correspondence between the gray scale and the target brightness and the correspondence between the gray scale and the is transmittance, thereby precisely controlling the backlight brightness dimming and data compensation and improving a visual effect.

Figure 6:
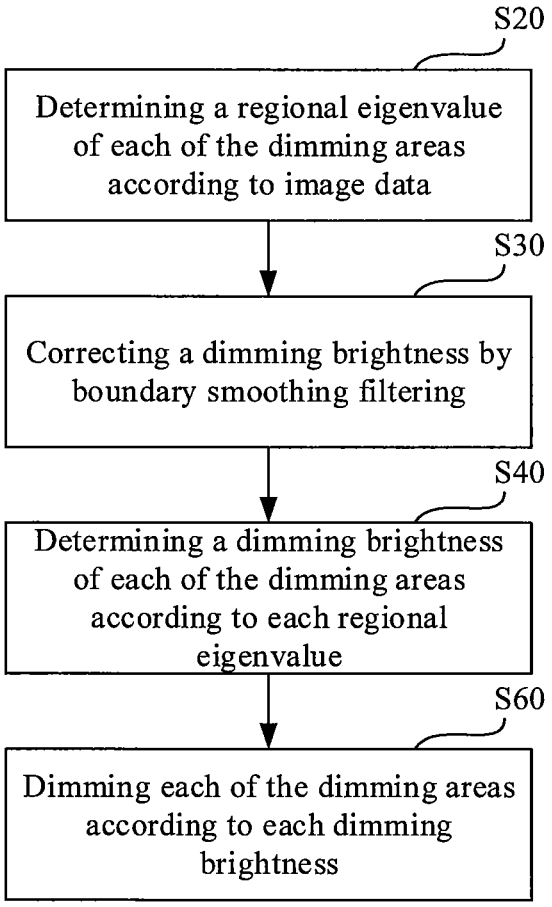
FIG. 6 is a schematic flowchart of a dimming method according to a yet another exemplary embodiment of the present disclosure.

FIG. 6 is a schematic flowchart of a dimming method according to a yet another exemplary embodiment of the present disclosure. In comparison with the dimming method as shown in FIG. 2, the dimming method in FIG. 6 further comprises the following step after the step S20:

S30: correcting the dimming brightness by boundary smoothing filtering.

The reason is that for each dimming area of the dimming screen 10 and each display area of the display screen 20, an obvious area partition line is prone to appear at the boundary of the two adjacent areas. The dimming method according to the present disclosure has a high requirement for the alignment accuracy of the dimming screen 10 and the display screen 20. If the alignment accuracy is not up to the standard, then it is easy to align the backlight of the dark area to the bright area at the boundary, which causes the edge of the bright area image to be cut to result in jagged burrs. In the above exemplary embodiment, the dimming brightness is corrected by boundary smoothing filtering, which can avoid jagged burrs on the edge of the display area, thereby further improving the visual effect.

In some exemplary embodiments according to the present disclosure, a Gaussian smoothing filter is used for boundary smoothing filtering. FIG. 7 is a schematic view of a Gaussian smoothing filter adopted according to an exemplary embodiment of the present disclosure. As shown in FIG. 7, the Gaussian smoothing filter having a 3×3 template is adopted in the exemplary embodiment. In other exemplary embodiments of the present disclosure, it is also possible to adopt a Gaussian smoothing filter having a 5×5 template, or other types of spatial filter commonly used in the art may be adopted for boundary smoothing filtering.

Figure 8:
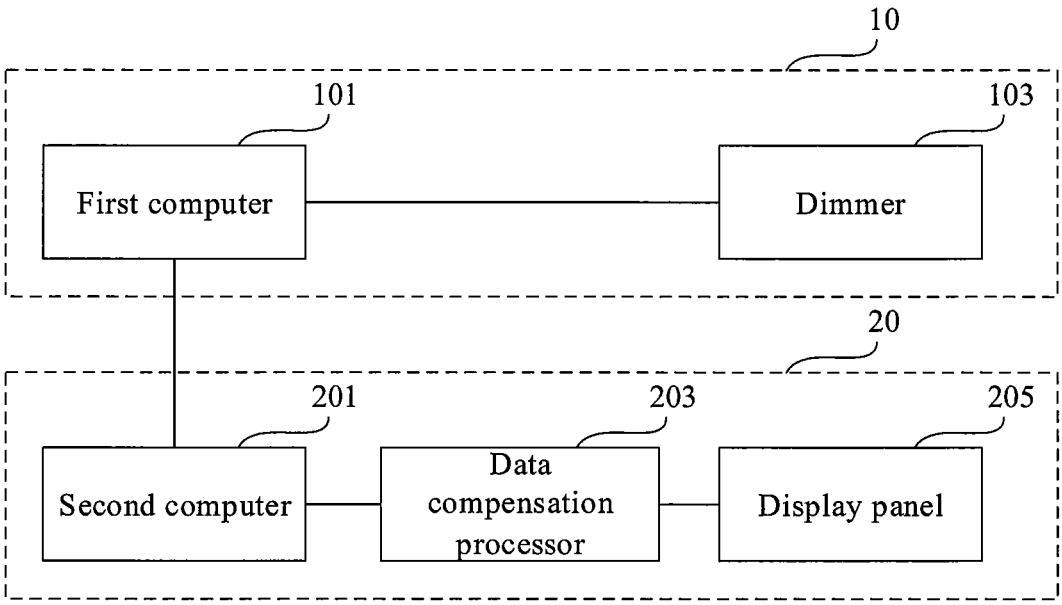
FIG. 8 is a structural schematic view of an LCD device according to an exemplary embodiment of the present disclosure.

FIG. 8 is a structural schematic view of an LCD device according to an exemplary embodiment of the present disclosure. The LCD device as shown in FIG. 8 may correspondingly implement the method as shown in FIG. 2, 3 or 4.

As shown in FIG. 8, the LCD device comprises a dimming screen 10 and a display screen 20, the dimming screen 10 comprises N×M dimming areas, the display screen 20 also comprises N×M display areas, wherein N and M are respectively positive integers greater than or equal to 1, and the dimming areas correspond to the display areas in a one-to-one relationship.

The dimming screen 10 comprises a first computer 101 and a dimmer 103. The first computer 101 may be configured to determine a regional eigenvalue of each of the dimming areas according to image data and determine a dimming brightness of each of the dimming areas according to each regional eigenvalue. The dimmer 103 may be configured to dim each of the display areas according to each dimming brightness.

In some exemplary embodiments of the present disclosure, the first computer 101 may be configured to determine the maximum or average value of gray scale in each of the dimming areas respectively as the regional eigenvalue of each of the dimming areas according to the image data. In addition, the first computer 101 may also be configured to determine whether the regional eigenvalue is less than a threshold: if it is not less than the threshold, configure the corresponding dimming brightness with the maximum brightness; and if it is less than the threshold, determine the corresponding dimming brightness in direct proportion to the regional eigenvalue.

The display screen 20 comprises a second computer 201, a data iii compensation processor 203 and a display panel 205. The second computer 201 may be configured to determine a target brightness of each of the display areas according to the image data and a correspondence between a gray scale and a target brightness, determine a transmittance of each of the display areas according to each target brightness and each corresponding dimming brightness, and determine a target gray scale of each of the display areas according to each transmittance and the correspondence between the gray scale and the transmittance. In some exemplary embodiments of the present disclosure, the second computer 201 may be configured to determine the transmittance and the target gray scale by means of the above formulas and the lookup tables. The data compensation processor 203 may be configured to make data compensation according to each target gray scale. The display unit 205 may be configured to correspondingly display in each of the display areas according to each target gray scale after data compensation.

Reference may be made to the depiction about the methods shown in e.g. FIGS. 2, 3 and 4 for the principles of dimming control and data compensation of the LCD device as shown in FIG. 8, which will not be reiterated herein.

Figure 9:
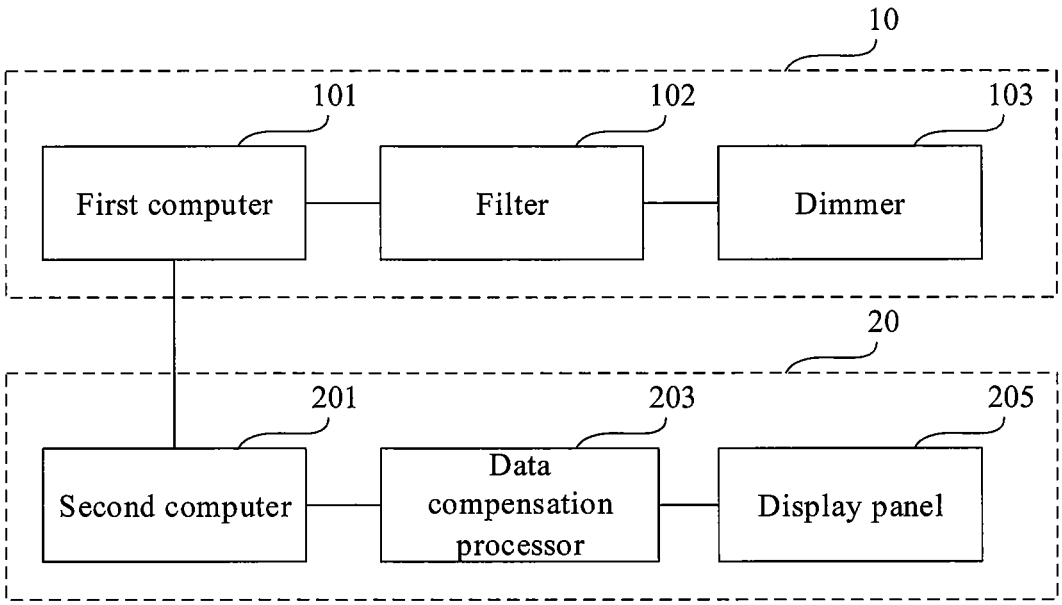
FIG. 9 is a structural schematic view of an LCD device according to another exemplary embodiment of the present disclosure.

FIG. 9 is a structural schematic view of an LCD device according to another exemplary embodiment of the present disclosure. In comparison with the LCD device as shown in FIG. 8, the LCD device in FIG. 9 only differs in that the dimming screen 10 further comprises a filter 102 configured to correct the dimming brightness by boundary smoothing filtering according to the dimming brightness of each of the dimming areas determined by the first computer 101 according to each regional eigenvalue, and then transmitting the corrected dimming brightness to a dimmer 103. In some exemplary embodiments of the present disclosure, the filter 102 may be configured as a Gaussian smoothing filter, such as, but not limited to, the Gaussian smoothing filter having a 3×3 template. Moreover, in other exemplary embodiments of the present disclosure, it is also possible to adopt a Gaussian smoothing filter having a 5×5 template or other types of spatial filter commonly used in the art.

Reference may be made to the depiction about the method shown in e.g. FIG. 6 and the methods shown in FIGS. 2, 3 and 4 for the principles of dimming control and data compensation of the LCD device as shown in FIG. 9, which will not be reiterated herein.

In some exemplary embodiments of the present disclosure, the LCD device as shown in FIGS. 8 and 9 are suitable for virtual reality (VR) applications. Moreover, in some exemplary embodiments of the present disclosure, the dimming screen 10 and the display screen 20 in the LCD device as shown in FIGS. 8 and 9 are liquid crystal screens.

According to some other exemplary embodiments of the present disclosure, there is also provided a non-volatile computer readable storage medium, on which a computer program is stored, and the computer program when executed by a processor realizes the dimming method provided by any exemplary embodiment of the present disclosure.

The flow charts and block diagrams in the accompanying drawings illustrate architectures, functions and operations that may be implemented according to the systems, methods and computer program products of the various exemplary embodiments of the present disclosure. In this regard, each of the blocks in the flow charts or block diagrams may represent a module, a program segment, or a code portion, said module, program segment, or code portion comprising one or more executable instructions for implementing specified logic functions. It should also be noted that, in some alternative implementations, the functions denoted by the blocks may occur in a sequence different from the sequences shown in the figures. For example, any two blocks presented in succession may be executed, substantially in parallel, or they may sometimes be executed in a reverse sequence, depending on the function(s) involved. It should also be noted that each block in the block diagrams and/or flow charts as well as a combination of blocks in the block diagrams and/or flow charts may be implemented using a dedicated hardware-based system executing specified functions or operations, or by a combination of a dedicated hardware and computer instructions.

The units or modules involved in some exemplary embodiments of the present disclosure may be implemented by means of software or hardware. The described units or modules may also be provided in a processor, for example, each of the described units may be a software program disposed in a computer or mobile intelligent device, or an individually configured hardware device, where the names of these units or modules do not in some cases constitute a limitation to such units or modules themselves.

The above description only provides an explanation of the exemplary embodiments of the present disclosure and the technical principles used. It should be appreciated by those skilled in the art that the scope of the present disclosure is not limited to the technical solutions formed by the particular combinations of the above-described technical features, and should also cover other technical solutions formed by any combinations of the above-described technical features or equivalent features thereof without departing from the concept of the disclosure, such as the technical solutions formed by replacing the above-mentioned features with technical features with similar functions disclosed in (but not limited to) the present application.

What is claimed is:

1. A dimming method for an LCD device, the LCD device comprising a light source, a dimming screen and a display screen, wherein the dimming screen is divided into N×M dimming areas, wherein the display screen is divided into N×M display areas, wherein N and M are positive integers greater than or equal to 1, and wherein the dimming areas correspond to the display areas in a one-to-one relationship, the dimming method comprising:

determining a maximum or an average value of gray scale in each of the dimming areas respectively as a regional eigenvalue of each of the dimming areas according to image data;

determining a dimming brightness of each of the dimming areas according to the regional eigenvalue of corresponding ones of the dimming areas; and dimming each of the dimming areas according to the dimming brightness of the corresponding ones of the dimming areas;

determining a target brightness of each of the display areas according to the image data and a correspondence between a gray scale and the target brightness;

determining a transmittance of each of the display areas according to the target brightness of corresponding ones of the display areas and a corresponding dimming brightness of the corresponding ones of the dimming areas;

determining a target gray scale of each of the display areas according to the transmittance of the corresponding ones of the display areas and a correspondence between a gray scale and the transmittance of the corresponding ones of the display areas; and making compensation according to the target gray scale of each of the display areas, wherein the dimming screen is between the light source and the display screen, so that light from the light source illuminates the dimming screen and then reaches the display screen after the dimming of the dimming screen, wherein the dimming area and the display area are respectively configured as a single pixel.

2. The dimming method according to claim 1, further comprising:

correcting the dimming brightness of each of the dimming areas by boundary smoothing filtering.

3. The dimming method according to claim 2, wherein correcting the dimming brightness of each of the dimming areas by boundary smoothing filtering comprises:

configuring a Gaussian smoothing filter to perform the boundary smoothing filtering.

4. The dimming method according to claim 1, wherein determining the dimming brightness of each of the dimming areas according to the regional eigenvalue of the corresponding ones of the dimming areas comprises:

determining whether the regional eigenvalue is less than a threshold;

when the regional eigenvalue is not less than the threshold, configuring the corresponding dimming brightness with a maximum brightness; and when the regional eigenvalue is less than the threshold, determining the corresponding dimming brightness in direct proportion to the regional eigenvalue.

5. The dimming method according to claim 1, wherein the target brightness is determined by the following formula:

$$L_{new} = \left(\frac{x}{255}\right)^{Gamma} g(L_{255-new} - L_{0-new}) + L_{0-new},$$

and wherein $L_{new}$ is the target brightness, x is the gray scale, Gamma is a curvature coefficient of the gray scale and the target brightness, $L_{255\text{-}new}$ is a maximum brightness of the display screen after dimming, $L_{0\text{-}new}$ is a minimum brightness of the display screen after dimming, and g is a proportional coefficient.

6. The dimming method according to claim 1, wherein the transmittance is determined by the following formula:

$$\eta = \frac{L_{new}}{L_{LCD1}},$$

and wherein η is the transmittance, $L_{new}$ is the target brightness, and $L_{LCD1}$ is the dimming brightness corresponding to the target brightness.

7. A non-transitory computer readable storage medium, on which a computer program is stored, the computer program, when executed by a processor, realizing the dimming method according to claim 1.

8. An LCD device comprising a light source, a dimming screen and a display screen, wherein the dimming screen is between the light source and the display screen, so that light from the light source illuminates on the dimming screen and then reaches the display screen after the dimming of the dimming screen, the dimming screen is divided into N×M dimming areas, the display screen is divided into N×M display areas, N and M are positive integers greater than or equal to 1, the dimming areas correspond to the display areas in a one-to-one relationship, and the dimming area and the display area are respectively configured as a single pixel, wherein the dimming screen comprises:

a first computer configured to:

determine a maximum value or an average value of gray scale in each of the dimming areas respectively as a regional eigenvalue of each of the dimming areas according to image data, and determine a dimming brightness of each of the dimming areas according to the regional eigenvalue of corresponding ones of the dimming areas; and a dimmer configured to dim each of the dimming areas according to the dimming brightness of the corresponding ones of the dimming areas, wherein the display screen comprises:

a second computer configured to:

determine a target brightness of each of the display areas according to the image data and a correspondence between a gray scale and the target brightness, determine a transmittance of each of the display areas according to each target brightness and each corresponding dimming brightness, and determine a target gray scale of each of the display areas according to each transmittance and a correspondence between the gray scale and the transmittance;

a data compensation processor configured to perform data compensation according to the target gray scale of each of the display areas; and a display panel configured to display in each of the display areas according to the target gray scale after data compensation.

9. The LCD device according to claim 8, wherein the second computer determines the target brightness according to the following formula:

$$L_{new} = \left(\frac{x}{255}\right)^{Gamma} g(L_{255\text{-}new} - L_{0\text{-}new}) + L_{0\text{-}new},$$

and wherein $L_{new}$ is the target brightness, x is the gray scale, Gamma is a curvature coefficient of the gray scale and the target brightness, $L_{255\text{-}new}$ is a maximum brightness of the display screen after dimming, $L_{0\text{-}new}$ is a minimum brightness of the display screen after dimming, and g is a proportional coefficient.

10. The LCD device according to claim 8, wherein the second computer determines the transmittance by the following formula:

$$\eta = \frac{L_{new}}{L_{LCD1}},$$

and wherein η is the transmittance, $L_{new}$ is the target brightness, and $L_{LCD1}$ is the dimming brightness corresponding to the target brightness.

11. The LCD device according to claim 8, wherein the dimming screen further comprises a filter configured to correct the dimming brightness of each of the dimming areas by boundary smoothing filtering.

12. The LCD device according to claim 8, wherein the first computer is further configured to perform operations comprising:

determining whether the regional eigenvalue is less than a threshold:

when the regional eigenvalue is not less than the threshold, configuring the corresponding dimming brightness with a maximum brightness; and when the regional eigenvalue is less than the threshold, determining the corresponding dimming brightness in direct proportion to the regional eigenvalue.

13. The LCD device according to claim 8, further comprising:

a filter configured to correct the dimming brightness of each of the dimming areas by boundary smoothing filtering.

14. The LCD device according to claim 13, wherein the filter comprises a Gaussian smoothing filter.

15. The LCD device according to claim 8, wherein the first computer is further configured to perform operations comprising:

determining whether the regional eigenvalue is less than a threshold;

when the regional eigenvalue is not less than the threshold, configuring the corresponding dimming brightness with a maximum brightness; and when the regional eigenvalue is less than the threshold, determining the corresponding dimming brightness in direct proportion to the regional eigenvalue.

16. The LCD device according to claim 8, wherein the dimming screen comprises a liquid crystal screen.

* * * * *